US005475899A

United States Patent [19]

Sramek

[11] Patent Number: 5,475,899

[45] Date of Patent: Dec. 19, 1995

[54] SLIVER CONTAINER STRUCTURE AND METHOD OF EXCHANGING SLIVER CONTAINERS

[75] Inventor: Rudolf Sramek, Liberec, Czechoslovakia

[73] Assignees: Textilnich Stroju A.S.; Elitex Usti Nad Orlici S.P., both of Czechoslovakia

[21] Appl. No.: 134,403

[22] Filed: Oct. 8, 1993

[30] Foreign Application Priority Data

Oct. 8, 1992 [CS] Czechoslovakia ..... 3067-92
Oct. 8, 1992 [CS] Czechoslovakia ..... 3069-92

[51] Int. Cl.[6] ..... D01H 9/00

[52] U.S. Cl. ..... 19/159 A; 57/281

[58] Field of Search ..... 19/159 R, 159 A, 19/160; 242/131, 129, 170, 171; 57/90, 281, 266, 268, 270; 206/388; 220/771; 414/389, 417

[56] References Cited

U.S. PATENT DOCUMENTS

| | | | |
|---|---|---|---|
| 509,568 | 11/1983 | Cooke et al. | 19/159 RX |
| 2,546,557 | 3/1951 | Naegli | 19/159 R |
| 2,877,505 | 3/1959 | Stephens | 19/159 R |
| 3,429,009 | 2/1969 | Goodner | 19/159 AX |
| 4,694,539 | 9/1987 | Langen | 19/159 A |
| 4,697,310 | 10/1987 | Raasch | 19/159 A |
| 4,977,738 | 12/1990 | Stahlecker | 57/281 |
| 5,237,726 | 8/1993 | Gartenmann et al. | 19/159 R |
| 5,276,947 | 1/1994 | Fritschi et al. | 19/159 A |

FOREIGN PATENT DOCUMENTS

| | | | |
|---|---|---|---|
| 270164 | 6/1988 | European Pat. Off. . | |
| 340459 | 11/1989 | European Pat. Off. . | |
| 0344484 | 12/1989 | European Pat. Off. | 19/159 A |
| 1395162 | 3/1965 | France | 19/159 R |
| 0229266 | 1/1967 | U.S.S.R. | 19/159 R |

*Primary Examiner*—C. D. Crowder
*Assistant Examiner*—Ismael Izaguirre
*Attorney, Agent, or Firm*—Ostrolenk, Faber, Gerb & Soffen

[57] ABSTRACT

A method and device for exchanging sliver containers on a sliver producing textile machine, particularly non-cylindrical containers, wherein the containers are supported on a support and are moved in a direction, perpendicular to their long axis past the coiling device. A respective shifting frame for the container to be filled and the adjacent container. The shifting frames grasp the two containers, raises them and enables the coiling device to fill the one container, then moves the containers to exchange the filled container for an empty one, and lowers the containers back to the supporting conveyor, wherein the sequence of filling and raising is selectively variable. The device carries out the foregoing steps. A non-circular sliver container has handles on opposite sides, particularly on its long sides, for being grasped by carrying means on the shifting frames of the device for raising and moving the containers. The handles may be holes in the container or recesses with bearing surfaces.

17 Claims, 5 Drawing Sheets

SLIVER CONTAINER STRUCTURE AND METHOD OF EXCHANGING SLIVER CONTAINERS

BACKGROUND OF THE INVENTION

1. Field of the Invention

The present invention relates to a method of exchanging sliver containers, and in particular non-circular sliver containers, after they have been filled in a filling station of a textile machine in which, at least during the exchange process, they are being moved in a direction perpendicular to their longitudinal axis plane.

The invention also relates to a device for carrying out the method described above, the device comprising a sliver coiling device having a lower section in which conveyors of empty and full sliver containers are located and between which conveyors is located a support carrying the container being filled.

The invention also relates to a sliver container used for carrying out the method, the container having at least one pair of oppositely facing members for cooperating with handling means.

2. The Prior Art

Spinning mills have recently been increasingly using non-circular cans as containers into which sliver is deposited. Then the cans are moved to machines which take the sliver from the non-circular cans and process it. Especially in automated spinning plants requiring exact orientation of the cans, the non-circular cans are very successful substitutes for circular cans which are difficult to precisely orient.

Two methods are known for filling non-circular cans with sliver. In the first method, the cans are filled at a sliver processing machine, for instance at an open-end spinning machine. An empty non-circular can is moved out of its working place and is filled by a moving filling device, which is provided specifically for this purpose. In the filling device, the non-circular can is moved with a reciprocating motion while it is being filled. When it is filled, it is put back. The filling device does not act as a sliver supply, as is the case, for instance, in the devices described in EP 270,164 or EP 340,459.

The working place of the sliver processing machine is out of operation for a considerable period of time during the process of filling the non-circular can. It appears to be more advantageous to fill the non-circular can at a filling station that is related to but not interfering with the sliver producing textile machine. In such a filling station, the sliver can be coiled and deposited into the non-circular can analogously with a previous solution, shown for instance in Czechoslovak Patent Application No. 1462-92. The non-circular can being filled is moved reciprocatingly in the direction of its non-circular, long axis plane, under the revolving coiling head. When the non-circular can is full, its motion is stopped. Then the conveyor is moved by one space in order to locate an empty can under the coiling head.

In this system, the replacement of a full non-circular can by an empty one cannot be carried out, especially at high feed speeds, without either interrupting the sliver deposition or coiling process or without reduction in the coiling speed. In each case, this reduces the output of the sliver producing machine and has a negative influence on the quality of the sliver being produced.

Besides, the inertial mass of the moving non-circular can is considerable. The mechanism which imparts reciprocating rectilinear motion to the non-circular can must be sized for moving the total mass of the full sliver filled non-circular can. For this reason, a coiling device for high sliver feed speeds has been developed in which the non-circular can is stationary and instead the revolving coiling head moves in the direction of the long axis plane of the non-circular can. This device ensures high quality sliver coiling and deposition at any sliver speed.

However, when the full non-circular can is exchanged for an empty can, the can filling speed must be reduced. Otherwise, a considerable quantity of the sliver would escape outside the non-circular can. The amount of the escaped slivers would depend on the filling speed. At high speeds, this means not only a considerable loss of sliver, but also creates a risk that the whole device will become locked and the conveyor of the non-circular cans will be damaged.

The known sliver containers are fitted with a sliver holder in which the sliver end is gripped whole in the sliver processing machine. The end is released and then processed, as described for instance in DE-OS 3,805,203 which corresponds to U.S. Pat. No. 4,977,738.

Since cylindrical containers present problems of orientation in automating spinning mills, CS Patent Application 2895-91 proposes using non-circular sliver containers, each having, on one shorter side under the upper edge of the container, a support table fixed thereto and provided with a groove intended to receive the reinforced sliver point. A recess interrupts the groove.

Known sliver receiving containers, whether cylindrical or non-circular, do not permit very rapid exchange of sliver containers after they have been filled with sliver in a filling station, i.e., rapid enough to avoid the necessity to reduce the coiling speed of the high speed sliver producing machine.

Abrupt speed reduction of a sliver producing machine, e.g. of a carding or drawing machine, results in deterioration of the quality of the sliver being produced. Thus, the invention proposes a method for exchanging a non-circular can, which has been completely filled in a filling station of a textile machine, with an empty one without speed reduction of the sliver producing machine at high sliver delivery or coiling speeds. The invention is also applicable for exchanging circular containers equipped with oppositely located members serving for handling means. The invention also intends to provide a device for and containers for carrying out the method.

SUMMARY OF THE INVENTION

The object of the invention is to exchange a sliver container, in particular non-circular sliver container, which has been filled in the filling station of a textile machine with an empty container. The containers are moved, at least during the exchange process, in the direction perpendicular to their long axis plane. The container being filled and the adjacent empty container are simultaneously grasped and moved by one spacing and then released, to replace the full container with the empty one.

After being grasped, the two containers can be raised, and after being moved can be lowered again.

It is also possible to grasp and raise the container being filled and the adjacent empty container during the filling of the fir container being filled and, when the container being filled is full, to move the two containers by one spacing, lower and release them.

According to another variant, when the container being filled is full, it and its adjacent empty container can be grasped, raised, moved by one spacing, and released.

A device for carrying out the method according to the invention comprises two shifting frames which carry means for simultaneously gripping and raising the container being filled and its adjacent empty container. The shifting means are mounted on the coiling device in a reversibly adjustable way. To simplify the design and to ensure functional reliability, each shifting frame is preferably coupled with a shifting device which is mounted on the frame of the coiling device.

A sliver container having handling means which are fitted on the sides of the container with recesses comprising a bearing surface and a raising surface can also be used for the method. In another variant, the sliver container handling means comprises holes in the container shell. In both container variants, the handling means can be provided on the longer sides of the container for a non-circular container.

Other features and advantages of the present invention will become apparent from the following description of the invention which refers to the accompanying drawings.

BRIEF DESCRIPTION OF THE DRAWINGS

Embodiments of the method, of the device for performing the method and of the sliver containers according to the invention are shown schematically in the accompanying drawings in which.

DESCRIPTION OF PREFERRED EMBODIMENTS

Figure 1:
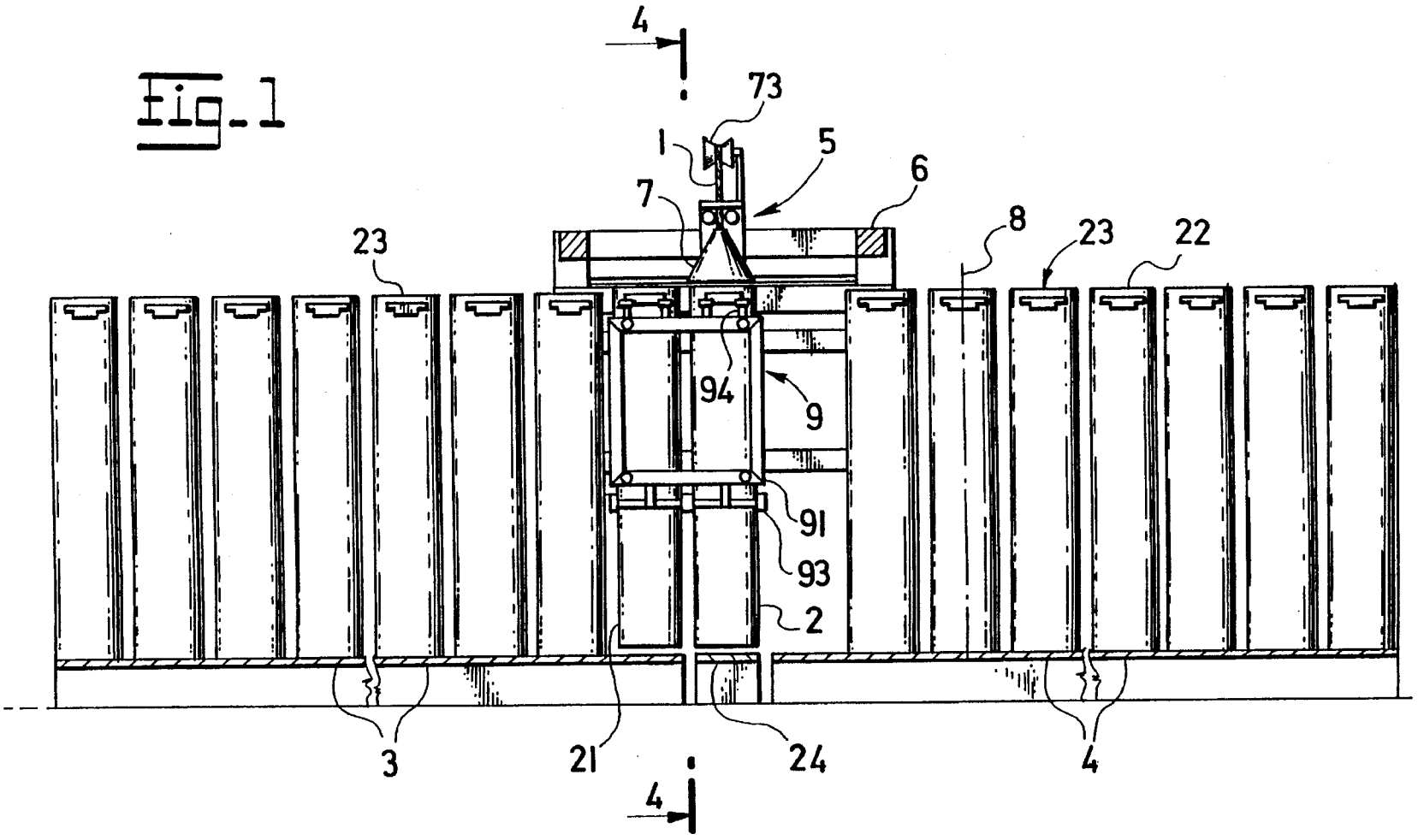
FIG. 1 is a front view of a filling station for non-circular containers.
Figure 2:
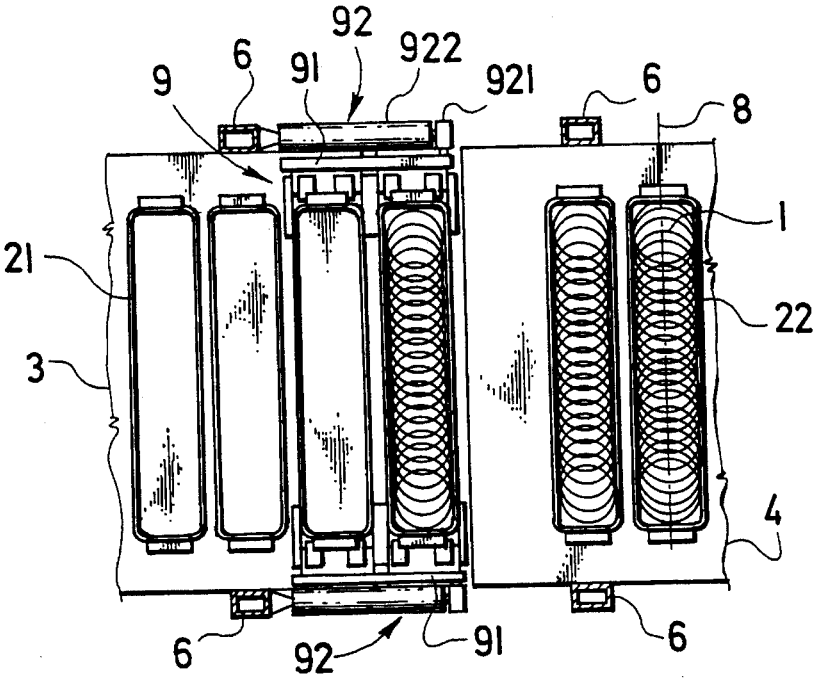
FIG. 2 is a plan view of a section of the filling station shown in FIG. 1 without the sliver coiling device and with a device for exchanging non-circular containers.
Figure 3:
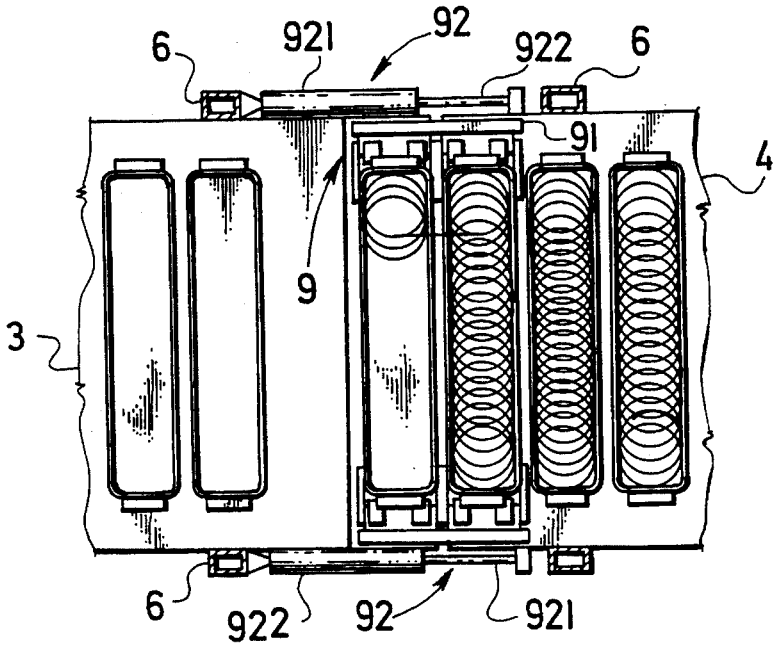
FIG. 3 is a plan view of part of the filling station according to FIG. 2 in the position taken after a full non-circular container has been replaced by an empty one.

A textile machine, not shown, for producing sliver 1, for instance, a carding or drawing machine, is related to or near to a filling station for sliver containers. In FIG. 1, non-circular containers 2 are fitted with clamping elements in the form of members 23 for handling means. The filling station comprises a conveyor 3 for empty non-circular containers 21 and aligned with it a conveyor 4 for full non-circular containers 22. A holder 24 for a non-circular container then being filled is situated between the conveyors 3. The conveyors 3, 4 of the empty and full non-circular containers 21, 22 are arranged in the lower section of or below a coiling device 5 which is adapted to coil the sliver 1 into the non-circular container 2 then below the device 5. In a frame 6 of the coiling device, there is a space for the passage of non-circular containers 2. The conveyors 3, 4 of the empty and full non-circular containers 21, 22 can be arranged also in a different way. However, it is necessary to arrange the place for the last empty non-circular container 21 on the conveyor 3 of empty non-circular containers and the place for the first full container 22 on the conveyor 4 of full containers in a line with the non-circular container 2 then being filled.

Figure 4:
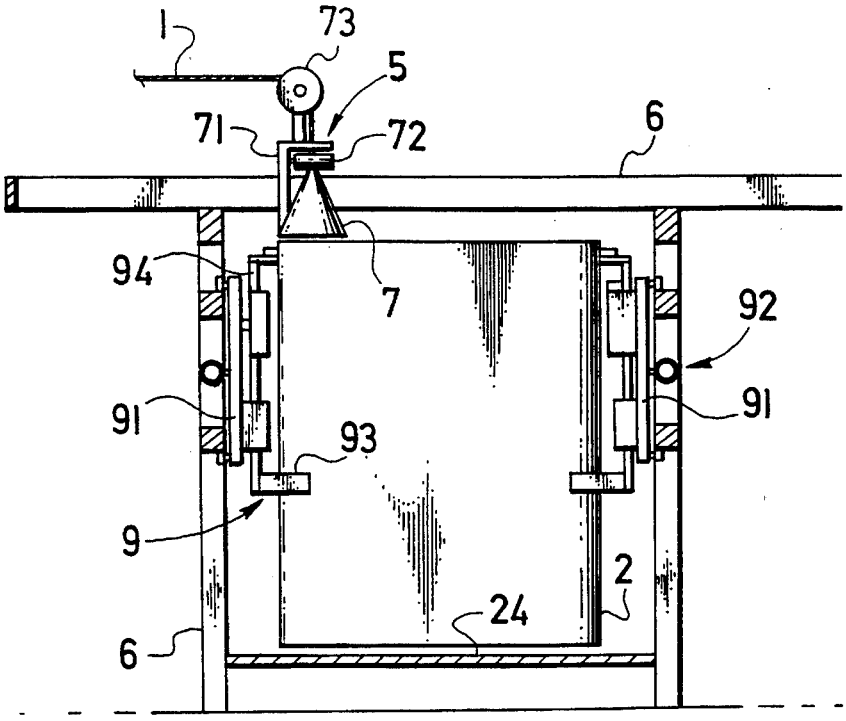
FIG. 4 shows a sectional view A—A through the device according to FIG. 1 with fixed non-circular containers.
Figure 5:
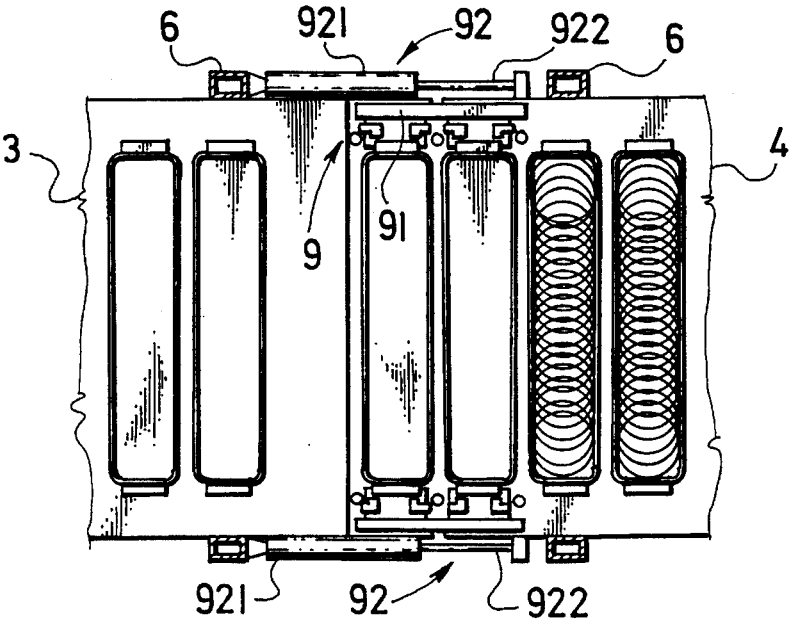
FIG. 5 shows the device according to FIG. 3 with released non-circular containers.

A known coiling head 7 (FIGS. 1 and 4) is seated in the upper part of the frame 6 of the coiling device. The head is equipped with an ancillary frame 71 which carries feed rollers 72 for the sliver 1 and also includes a guiding roller 73. The coiling head is also fitted with a known, not shown, revolving, can plate with a sliver coiling tube. The coiling head 7 is mounted on the frame 6 of the coiling device to be reversibly moveable or reciprocate over the non-circular container 2 then being filled. The distance between the end points or dead points of the coiling head equals the length of the non-circular container 2, minus the coiling diameter of the revolving can plate of the coiling head 7. The path of the reciprocating rectilinear motion of the axis of rotation of the can plate of the coiling head 7 lies in the long axis plane 8 of the non-circular container 2. This reciprocating rectilinear motion of the coiling head 7 is actuated by a known, not shown mechanism, for instance by a known motion screw, connected with a reversing drive.

A grasping mechanism 9 (FIGS. 1–5) for two non-circular containers 2 is adjustably mounted on the frame 6 of the coiling device of the coiling head. That mechanism comprises two shifting frames 91 seated opposite each other and connected with a moving member 921 of a displacing mechanism 92. The end points or dead points of the moving member 921 of the displacing mechanism 92 are spaced apart the distance of one spacing between the containers 2. A fixed part 922 of the displacing mechanism 92 is fixed to the frame 6 of the coiling device.

In the illustrated embodiment, the shifting frame 91 carries extending grasping forks 93 which, in their extended position, embrace two adjacent non-circular containers 2, i.e., the non-circular container 2 located under the coiling head 7 and then being filled, and the adjacent empty non-circular container 21 next to be filled.

The grasping forks 93 can also be adapted to swing away. The shifting frame 91 also carries raising means 94 for raising the non-circular container 2 by bearing up on the members 23 which serve as handling means. The members 23 are fixed in the upper part of the non-circular can 2 on its opposite narrow sides. The raising means are mounted on and are extendable with respect to the shifting frame 91 in a known manner and they represent the handling means for the containers 2. The raising means 94 are also coupled with a not shown raising device which is used to raise the pair of the non-circular containers 2 before displacing them.

The sliver 1 is being produced in a not shown textile machine at a constant speed. It is supplied at this speed by the feed rollers 72 into the coiling head 7. Due to the reciprocating rectilinear motion of the coiling head 7 and to the revolving motion of the can plate, the sliver 1 is coiled in cycloids into the non-circular container 2 being filled, which is located in an exactly defined position under the coiling head 7. During the filling process, the non-circular container 2 being filled is also being grasped and raise by means of the grasping mechanism 9 simultaneously with the adjacent empty container 21. The two non-circular containers 2, 21 are fixed in the raising means 94 which grasps their members 23 for handling means on the two opposite sides of the related non-circular containers 2, 21. At this time, the lower parts of the two non-circular containers 2, 21 are placed between the grasping forks 93 for ensuring the vertical position of the non-circular containers 2, 21.

The empty non-circular container 22 is situated at the adjacent end of the conveyor 3 of the empty non-circular containers 21. At this time, the non-circular container 2 just receiving the sliver 1 is on a separate working place, outside the two conveyors 3, 4 for the non-circular containers. This separate working place may comprise a not shown mechanism for handling the not shown bottom of the non-circular container 2.

During the filling process, the two grasped non-circular containers 2, 21 are raised by the raising means 94 and then continue to be filled while in the raised position. At least the first deposit place for the full non-circular container 22 on the conveyor 4 of the full non-circular containers 22 is free. The amount of sliver 1 already filled or introduced into the non-circular container 2 can be monitored by any known method, for instance by means of a sliver feeler, or by measuring the length of the coiled sliver or by weighing the container.

When the non-circular container 2 situated under the coiling head 7 has been completely filled with sliver 1, a not shown control device sends out a pulse to replace the filled non-circular container 2 with an empty one. This pulse of the control device starts operation of the displacing mechanism 92 of the gripping mechanism 9. The displacing mechanism can, for instance, be an air cylinder. This mechanism extends the moving member 921 of the displacing mechanism 92 and that motion is shared by the shifting frame 91 connected with it. The raising means 94 and the grasping fork 93 mounted on the shifting frame 91 simultaneously carry the two fixed non-circular containers 21, 2. The motion of the moving member 921 of the displacing mechanism 92 with the non-circular containers 21, 2 fixed in the raising means 94 and in the grasping forks 93 goes at high speed and without interruption of the sliver 1 deposition process carried out by the coiling head 7.

In another embodiment, not shown, the two non-circular containers 2, 21 are first grasped by the raising means 94 and by the grasping forks 93 during the filling process. When the container 2 being filled is full, the two non-circular containers 2, 21 are raised by means of the raising means 94 and then displaced. Also, the process of grasping and raising the two non-circular containers 2, 21 can be carried out after the non-circular container 2 has been filled completely, and can then be immediately followed by the displacement of the two non-circular containers 2. 21. However, each of these variants increases the time interval required to replace the full non-circular container 2 with the empty non-circular container 21.

After the pair of the fixed non-circular containers 2, 21 has been moved by one spacing, the raising means 94 lower to their lowered position with the empty non-circular container 21 placed under the coiling head 7 for receiving the sliver 1. The full non-circular container 2 has reached its predetermined position at the beginning of the conveyor 4 of full non-circular containers 22. The grasping forks 93 and the raising means 94 are shifted or lifted away from the non-circular containers 2, as far as possible outside the path of the non-circular containers 2. The displacing mechanism 92 receives then the order to return to its initial position. At the same time or subsequently, the conveyor 3 of empty non-circular cans moves the empty non-circular cans 21 by one spacing, thus filling, on the conveyor 3 of the empty non-circular containers 21, the last place for the empty non-circular container 21 freed at the preceding operation of the displacing mechanism 92.

After these operations have been finished, i.e., after the return of the displacing mechanism 92 to its initial position and the filling of the freed last place on the conveyor 3 of empty containers, the raising means 94 and the grasping forks 93 are shifted or lifted toward the non-circular containers 2. This causes a pair of non-circular containers 2, 21 consisting of the non-circular container 2 undergoing the filling operation and of its adjacent empty non-circular container 21, to again be fixed in the grasping forks 93 and, after being raised by the raising means 94, ready to carry out the next replacement of the non-circular containers 2, 21 when the non-circular container 2 has been filled.

In an alternative embodiment, the non-circular containers can be replaced by circular ones fitted with members 23 for handling means, positioned opposite each other for instance, fixing blocks fixed to the outer shell of the container.

In this embodiment, not shown, the carrier of the container being filled revolves during its filling process under the coiling head. When the container is at the end of its filling process, i.e., it is full, it stops in a position in which one axis plane is perpendicular to the direction of the motion of the containers during their exchange. Analogously to the non-circular containers, the one axis plane of the circular container is the plane passing through the axis of the circular container and the centers of the grasping elements. When it has stopped, the full container together with its adjacent, similarly oriented empty container, is grasped by the grasping device. Then the two containers are raised, moved by one spacing, lowered and released from the grasping device.

Figure 6:
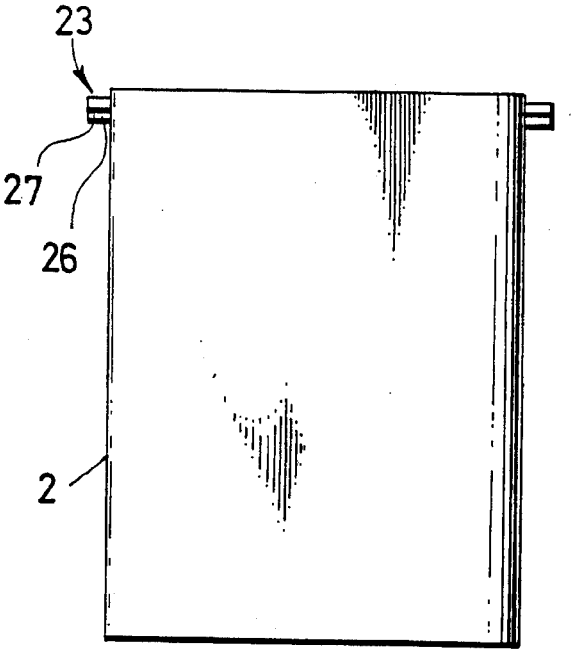
FIG. 6 is a front view of a first example of an embodiment of a non-circular container.

The embodiment shown in FIG. 6 represents a non-circular container 2 for the sliver 1 having an elongate plan view cross section. The dimensions of the non-circular container 2 of the sliver 1 are chosen to ensure effective use for the space under the known, not shown, open end spinning machine under whose not shown spinning stations the non-circular containers 2 of the sliver 1 are arranged side by side in a row in a known manner.

In this embodiment, the non-circular container 2 for the sliver 1 is fitted with members 23 for handling means situated facing each other on the opposite walls of then non-circular container 2, as in the embodiment shown in FIG. 1 in the upper part of the shorter walls of the non-circular container 2.

Figure 7:
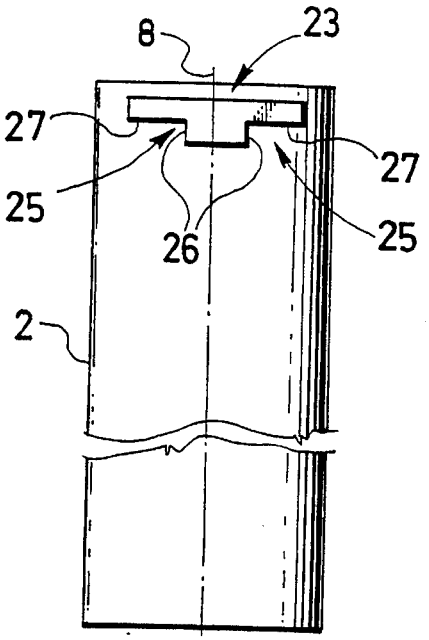
FIG. 7 is a side view of the non-circular container according to FIG. 6.

The members 23 for the handling means are equipped with recesses 25 on the lateral walls, as shown in FIG. 7. Each recess 25 includes a bearing surface 26, which is parallel to the horizontal direction of motion of the grasping fork 93, and a raising surface 27, which is not parallel to the vertical direction of motion of the raising means. FIG. 7 shows the most advantageous embodiment of the recesses 25 of the members 23 for the handling means, in which the bearing surface 26 is vertical and the raising surface 27 is horizontal. The members 23 for the handling means can be equipped with grooves intended to receive the end of the sliver 1 and arranged in one of the known shapes, or the sliver holder can be arranged on another part of the container 2.

Figure 10:
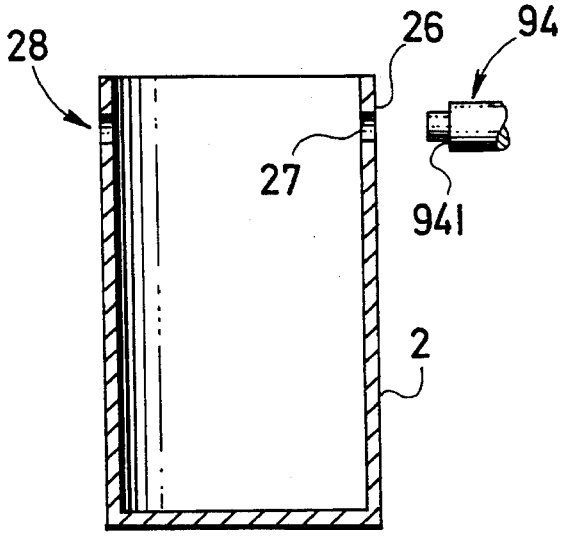
FIG. 10 is an embodiment of a cylindrical container with one type of container handling means.

This embodiment of non-circular sliver containers 2 is intended for filling stations in which the containers 2 move during the replacement of a filled container 2 by an empty container 2 which is to next receive the sliver 1, in a direction perpendicular to the long axis plane 8 of the container 2. The members 23 for the handling means can be made also in another manner, for instance, by shaped sections or by holes, in each case, however, having at least one raising surface 26 and one or two bearing surfaces 27, as shown for instance in FIGS. 10 to 12. Thus, FIG. 10 shows cylindrical holes provided in the shell of the container 2 and intended to receive the raising means 94 adapted to carry out rectilinear motion. In this case, the raising means 94 is a stepped cylinder whose front surface 941 bears on the bearing surface 36 consisting in the surface of the shell of the container 2 around the related hole 28. In this embodiment, the upper part of the hole 28 is the raising surface 27. To improve the grasping of the container, the holes 28 can assume various adequate shapes.

The container shell may comprise shaped parts 29 without holes having a shape analogous to that of the holes 28. This has the additional advantage that the shell of the container 2 is not interrupted so that no mechanical means, for instance the raising means 94, contact the sliver 1.

Figure 8:
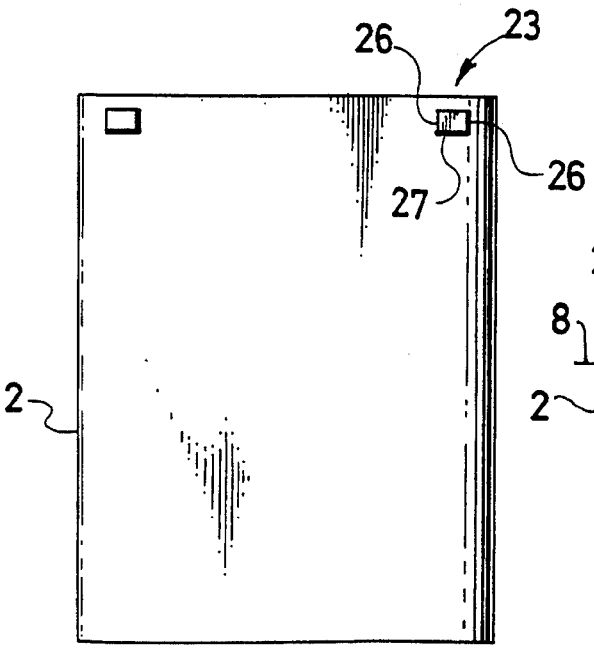
FIG. 8 is a front view of a second variant of embodiment of a non-circular container.
Figure 9:
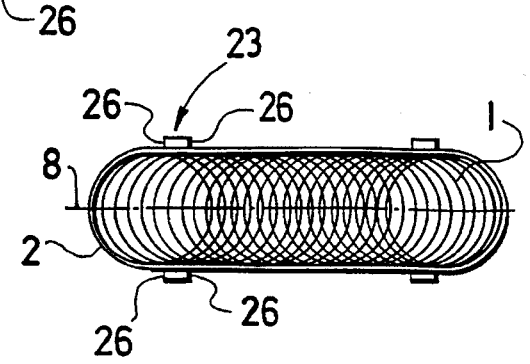
FIG. 9 is a plan view of the embodiment of the non-circular container according to FIG. 8.

In another embodiment, shown in FIGS. 8 and 9, the non-circular container 2 of the sliver 1 is fitted with two pairs of the members 23 for the handling means positioned facing each other on the longer opposite sides of the container 2 of the sliver 1. The members 23 are prism-like bodies having lateral walls which serve as bearing surfaces 26 and having lower walls which serve as the raising surface 27.

This embodiment is intended for fixing and raising the containers 2 during their exchange in cases in which the direction of motion during the exchange of the container 2 is parallel with the long axis plane 8 of the container 2 of the sliver 1. The members 23 for handling means can be made in the same manner as in the preceding embodiment shown in FIGS. 6 and 7. But, it is preferable to make them for instance as holes 28 or shaped parts 29 in the shell of the container 2 of the sliver 1, as shown in FIGS. 10 to 12.

Figure 11:
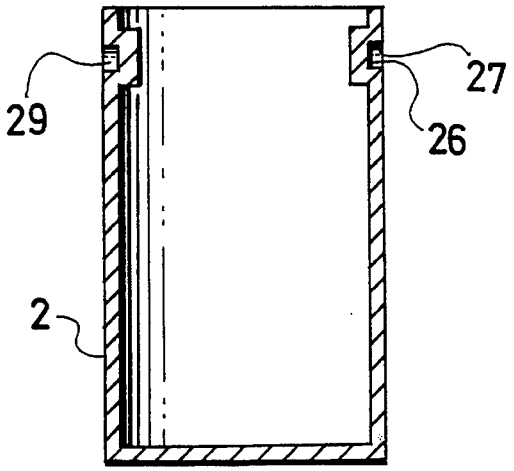
FIG. 11 is another embodiment of a container with another type of handling means.
Figure 12:
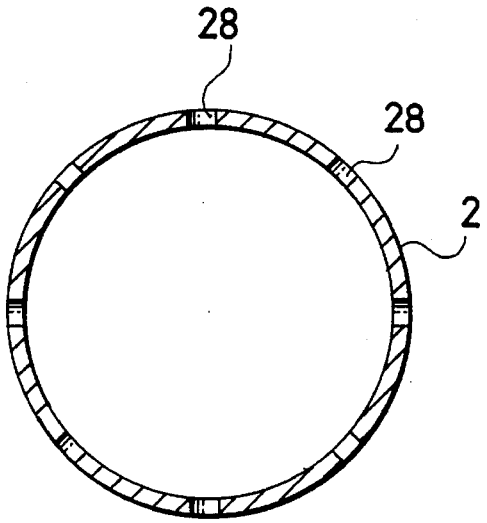
FIG. 12 is a plan, sectional view of another embodiment of cylindrical container.

In the embodiments shown in FIGS. 10 to 12, the pair of the members 23 for handling means is situated opposite each other on the cylindrical container 2 of the sliver 1. In this embodiment, as well, the members 23 can be made in various embodiments, for instance as shaped parts 29 or holes 28 in the shell of the container 2. The most advantageous version here is that with the shaped parts 29, because they neither protrude outside the shell of the cylindrical container 2 nor interrupt the shell by holes.

The cylindrical container 2 of the sliver 1 can include a plurality of pairs of the members 23 positioned opposite each other and distributed along the circumference of the cylindrical container 2 for the sliver 1. This reduces the time required for obtaining the correct angular position of the container 2 to be grasped because it is sufficient to turn the container 2 through a smaller angle. The members 23 can also be made as bodies fixed on the circumference of the container, as shown in FIGS. 1 to 4.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A method of exchanging sliver containers in a filling station of a textile machine, each of the sliver containers having a pair of first sides and a pair of second sides, each of the first sides being longer than each of the second sides, the method comprising the steps of:

arranging the sliver containers in a row;

moving the row of sliver containers;

filling one of the containers in the row;

simultaneously grasping the container being filled and an adjacent empty container to be filled next and moving the two grasped containers in a direction substantially parallel to the second sides by the spacing of one container for replacing the filled container with the empty container.

2. The method of claim 1, wherein the grasping and moving of the containers comprises grasping the containers, raising them off a support thereof, moving the two containers by one spacing and lowering the containers again to the support.

3. The method of claim 2, wherein the two containers are grasped and raised during the filling process, filling the one raised container with sliver while the containers are raised;

after the one container has been filled, the two containers are moved by the one spacing and are lowered, and thereafter releasing the two containers.

4. The method of claim 2, wherein the two containers are grasped, the one of the two containers is filled and upon the one container being filled, the two containers are raised and moved by one spacing and lowered, and the thereafter releasing two containers from being grasped.

5. The method of claim 2, comprising filling the one container with sliver and after the one container is filled, the two containers are grasped, raised, moved by one spacing and lowered, and thereafter releasing the two containers from the grasp.

6. The method of claim 2, wherein the containers are non-cylindrical sliver containers and the moving of the containers by one spacing is in a direction perpendicular to their respective long axis planes.

7. A device for exchanging sliver containers in a textile machine which produces and stores sliver, comprising:

a sliver coiling and depositing device having a lower section; a first conveyor for empty containers and a second conveyor for full sliver containers both in the lower section; a holder between the first and second conveyors for holding one of the empty containers that is positioned to be filled;

a reversibly adjustable shifting frame supported on the coiling device, including carrying means for simultaneously grasping, raising and lowering both of the one container positioned to be filled by the coiling device and an adjacent empty container.

8. The device of claim 7, further comprising a displacing mechanism mounted on the frame of the coiling device for displacing the carrying means for the containers for displacing the shifting frame by one space for moving a filled container away from the sliver coiling device and replacing it with the empty container at the device.

9. The device of claim 8, further comprising a plurality of the containers to be filled, each of the containers including a pair of opposite handling means on opposite sides thereof for being engaged with the carrying means of the shifting frame on the device.

10. A sliver container for receiving sliver from a sliver producing textile machine, comprising a container having sides; a pair of handling members serving as handling means for the container and situated at opposite sides of the container, wherein the handling members include substantially T-shaped members comprising a vertically oriented bearing surface and a horizontally oriented raising surface; and the vertically oriented bearing surface comprises at least two vertical surfaces for receiving at least two transverse moving surfaces of a handling means and the horizontally oriented raising surface comprises at least two horizontal surfaces for receiving at least two raising surfaces of the handling means.

11. The sliver container of claim 10, wherein the handling means comprise holes in at least one of a plurality of walls of the container.

12. The sliver container of claim 10, wherein the sliver container is a non-cylindrical sliver container having respective longer and shorter pairs of opposite sides and the members for the handling means are situated on the shorter opposite sides of the container.

13. A device for exchanging sliver containers, the device comprising:

at least one conveyor movably supporting a plurality of empty sliver containers, a plurality of full sliver containers and a sliver container being filled which is located below a sliver coiling and depositing device to be filled with sliver from the sliver coiling and depositing device; and a movable grasping mechanism for simultaneously grasping both the sliver container being filled and an adjacent empty sliver container, simultaneously raising both containers during a sliver container filling operation and simultaneously moving both containers after the sliver container being filled is full so that the adjacent empty container is located below the sliver coiling and depositing device to be filled with sliver.

14. The device of claim 13, wherein the movable grasping mechanism comprises grasping forks and raising members for simultaneously raising both containers.

15. The device of claim 14, wherein the grasping forks and raising members are adapted to be shifted away from the full container and the adjacent empty container which is positioned beneath the sliver coiling and depositing device after movement of the both containers and moved into a position for grasping the container positioned beneath the sliver coiling and depositing device and an adjacent empty container.

16. The device of claim 13, further comprising a first conveyor for movably supporting the plurality of empty containers, a second conveyor for movably supporting the plurality of full containers and a stationary support disposed between the first and second conveyers for supporting the container located below the sliver coiling and depositing device.

17. The device for claim 13, wherein each of the empty and full sliver containers has a pair of longer sides and a pair of shorter sides, wherein the movable grasping mechanism is adapted to move the both containers in a direction substantially parallel to the shorter sides by a distance about equal to a width of one of the shorter sides.

* * * * *